US005632709A

United States Patent [19]

Walsh

[11] Patent Number: 5,632,709

[45] Date of Patent: May 27, 1997

[54] REMOVABLE SHOE WEIGHT

[76] Inventor: Dennis Walsh, 1902 Lydia Dr., Lafayette, Colo. 80026

[21] Appl. No.: 430,479

[22] Filed: Apr. 28, 1995

[51] Int. Cl.[6] ..... A63B 21/065; A43B 23/00

[52] U.S. Cl. ..... 482/105; 36/136; 482/74; 482/79; 482/93; 482/148

[58] Field of Search ..... 482/51, 74, 79, 482/92, 93, 105, 139, 148; 36/132, 136; 24/712.4, 712.9; 2/245; D2/978

[56] References Cited

U.S. PATENT DOCUMENTS

| | | | |
|---|---|---|---|
| D. 205,594 | 8/1966 | McCrory et al. . | |
| D. 336,971 | 7/1993 | Flisek . | |
| 1,515,665 | 11/1924 | Eck . | |
| 1,548,172 | 8/1925 | Redden . | |
| 2,662,677 | 5/1953 | Perry . | |
| 2,871,537 | 2/1959 | Hickerson | 36/136 |
| 3,039,273 | 6/1962 | Swindell | 482/105 |
| 3,114,982 | 12/1963 | McGowan . | |
| 3,306,610 | 2/1967 | Biggs, Jr. et al. . | |
| 3,334,898 | 8/1967 | McCrory et al. . | |
| 3,528,652 | 9/1970 | Tarbox . | |
| 4,252,315 | 2/1981 | Kimura | 482/105 |
| 4,322,072 | 3/1982 | White . | |
| 4,327,512 | 5/1982 | Oliver | 36/136 |
| 4,357,009 | 11/1982 | Baker | 482/105 |
| 4,458,432 | 7/1984 | Stempski . | |
| 4,507,882 | 4/1985 | Harrell | 36/136 |
| 4,597,198 | 7/1986 | Schweitzer | 36/136 |
| 4,777,743 | 10/1988 | Roehrig, Jr. . | |
| 4,789,270 | 12/1988 | Selisky | 482/105 |
| 4,997,183 | 3/1991 | Winston . | |
| 5,063,690 | 11/1991 | Slemker | 36/136 |
| 5,094,016 | 3/1992 | DiVito . | |
| 5,119,539 | 6/1992 | Curry | 24/712.9 |
| 5,162,032 | 11/1992 | Dohner . | |
| 5,231,776 | 8/1993 | Wagner . | |
| 5,246,749 | 9/1993 | Handzlik | 36/136 |
| 5,311,679 | 5/1994 | Birch, Sr. | 36/136 |

FOREIGN PATENT DOCUMENTS

| | | |
|---|---|---|
| 2139103 | 11/1984 | United Kingdom . |

*Primary Examiner*—Richard J. Apley
*Assistant Examiner*—Victor K. Hwang
*Attorney, Agent, or Firm*—Rick Martin

[57] ABSTRACT

An aesthetically pleasing weight for shoes allows a user to customize his or her workout. The shoe weight slips under the shoelaces of workout shoe. The shoe weight is held firmly in place by the shoelace tension and shape of the shoe weight. A secondary securing cord can be used as a backup to hold the weight in position. The intensity of the workout can be varied by the number and magnitude of weight the user selects. Different muscle groups can be targeted by adjusting the position on the shoe on which the weight(s) is secured. The shoe weight is attractively shaped of polished metal. Conversely, the shoe weights can be coated. The coating can be colored, textured or the like.

12 Claims, 2 Drawing Sheets

REMOVABLE SHOE WEIGHT

FIELD OF INVENTION

The present invention relates generally to removable weights for shoes. The invention more particularly relates to removable weights that slip under a shoe's laces to enhance the benefits of training or walking.

BACKGROUND OF THE INVENTION

Physical fitness has become a high priority in today's world. New fitness devices and methods to increase the benefits of each workout are, therefore, in high demand. Weighted athletic shoes and ankle weights are thought to enhance leg strength and cardiovascular performance by increasing the resistance to a wearer's movement while exercising. The same devices are effective even when the wearer is simply walking. Accordingly, weighted athletic shoes and ankle weights have been available for years.

Existing weighted athletic shoes and ankle weights, however, have several disadvantages that are solved by the present invention. The following patents exemplify the sorts of devices that are well known in the prior art.

U.S. Pat. No. 3,114,982 (1963) to McGowan discloses a removable side pouch that snaps onto the side of an athletic shoe. The side pouch contains one or more pockets for receiving weights for athletic training. The present invention slips under a shoe's laces, and does not require any permanent alteration, such as mounting side snaps, for use with a shoe.

U.S. Pat. No. 4,458,432 (1984) to Stempski discloses an athletic shoe having removable weights for training. A series of hook and loop material toe and side pockets hold the weights to the shoe. The present invention slips easily under a conventional shoe's laces and does not require pockets.

U.S. Pat. No. 4,777,743 (1988) to Roehrig, Jr. discloses an athletic shoe having removable weights for training. Weights are inserted into a pocket that is fixed to the shoe collar that encircles the wearer's ankle. The present invention slips under a shoe's laces, and does not require special shoe construction.

U.S. Pat. No. 5,162,032 (1992) to Dohner discloses an ankle belt having weight pockets. The present invention is not an ankle weight.

U.S. Pat No. 5,231,776 (1993) to Wagner et al. discloses an integrally weighted athletic shoe having spherical weights evenly distributed throughout the shoe's inner sole. The present invention is not permanently fixed to a shoe and is, therefore, removable and adjustable. Furthermore, the present invention allows weight to be located in strategic areas on the foot rather than being uniformly distributed along the length of the shoe.

U.S. Pat. No. Des. 205,594 (1966) to McCrory discloses an ornamental design for an ankle wrap having weight pockets. The present invention is not an ankle weight.

U.S. Pat. No. 3,334,898 (1967) to McCrory discloses an ankle wrap having weight pockets. The present invention is not an ankle weight.

U.S. Pat. No. Des. 336,971 (1993) to Flisek discloses an ornamental design for a training shoe with over the lace removable weights. Apparently a hook and loop type fastener holds the weights above the shoe laces. The present invention fits under a shoe's laces, and does not require a hook and loop fastener.

U.S. Pat. No. 1,515,665 (1924) to Eck discloses a toe weight that is screwed to the front sole of an athletic shoe.

The present invention is implemented without any alteration to a shoe. The present invention slides under a shoe's laces rather than attaching to the sole.

U.S. Pat. No. 1,548,172 (1925) to Redden discloses a shoe having an ankle brace in its upper portion. The present invention is not an ankle brace.

U.S. Pat. No. 2,662,677 (1950) to Perry discloses a pair of golf shoes with side pockets for holding golf tees. The present invention does not use pockets, nor hold golf tees.

U.S. Pat. No. 3,306,610 (1967) to Biggs, Jr. et al. discloses a weighted gaiter or spat. The present invention is a weight for a shoe, not for a gaiter or spat.

U.S. Pat. No. 3,528,652 (1968) to Tarbox discloses a contoured ankle weight. The lower edge of the ankle weight can be secured to an athletic shoe by threading lace 26 through hook 24. The present invention is not an ankle weight.

U.S. Pat. No. 4,322,072 (1982) to White discloses a leg weight apparatus for exercising while seated on a chair. The present invention is used with shoe laces, and does not require a chair for use.

U.S. Pat. No. 4,997,183 (1991) to Winston discloses an ankle weight strap. The present invention is a shoe weight, not an ankle weight.

U.S. Pat. No. 5,094,016 (1992) to DiVito discloses a flexible pocket that mounts on shoe laces for carrying items such as keys. The present invention does not use pockets, rather, it slides under a shoe's laces.

U.K. Pat. No. 2,139,103 (1983) to Rogers discloses a side pocket for removably holding training weights to an athletic shoe. The shoe laces fasten to the leading edge of the side pocket and rear strap secures the rear of the pocket. The present invention is not mounted on the side of the shoe, nor does it require pockets for securing training weights.

The present invention solves many problems that are not addressed by the cited prior art. Conventional ankle weights do not allow weights to be placed at strategic locations, thereby working different muscle groups. Furthermore, because ankle weights necessarily encircle the ankle, the movement (the length of the moment arm) around the ankle pivot is zero; therefore, development of the muscle groups that rotate the ankle are not enhanced. Ankle weights can also lead to calluses and injury to a wearer by contacting the wearer's ankle during training. Ankle weights are bulky and tend to be aesthetically unappealing.

The present invention slips under a shoe's lace. The present invention can, therefore, be placed at strategic positions, from the toe to near the ankle, to stimulate specific muscle groups. The present invention enhances development of ankle rotating muscle groups. The present invention does not directly contact a wearer, thereby minimizing injury and calluses. The present invention is compact and aesthetically appealing.

The majority of the above described shoe weights require permanent alteration to the shoe and/or use pockets. The prior art designs tend to be visually unappealing, bulky, and do not allow weight to be strategically placed to work different muscle groups. The present invention does not require shoe alteration or use pockets. The present invention is, therefore, less bulky, less likely to wear out, compact and visually appealing. Furthermore, the location of the present invention can be varied from toe to near the ankle to stimulate development of predetermined muscle groups.

SUMMARY OF THE INVENTION

The primary object of the present invention is to provide a removable shoe weight that is secured to the top of a shoe by sliding underneath the shoe's lace.

Another object of the present invention is to provide a shoe weight whose location on a shoe can be adjusted to stimulate predetermined muscle groups for development.

Another object of the present invention is to provide a removable shoe weight in various weight magnitudes, whereby the degree of physical resistance can be varied by selecting a desired amount of weight.

Another object of the present invention is to provide a shoe weight that is aesthetically appealing.

Another object of the present invention is to provide a secondary safety strap to secure the shoe weight beneath the shoe laces.

Another object of the present invention is to provide shoe weights that vary in color, thereby enhancing the aesthetic appeal.

Other objects of this invention will appear from the following description and appended claims, reference being had to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
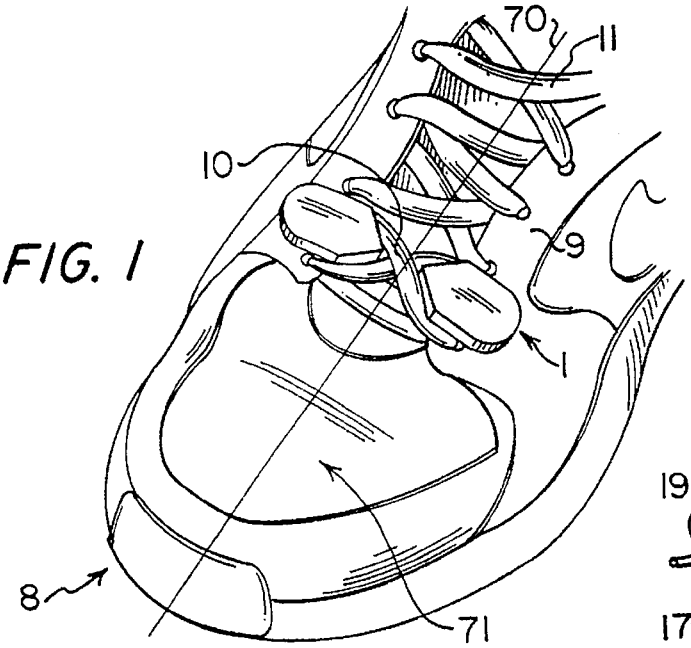
FIG. 1 is a top perspective view of a prior art shoe with the alternate bow shaped embodiment of the present invention.
Figure 2:
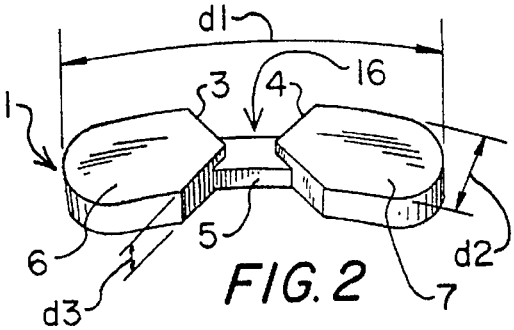
FIG. 2 is a top perspective view of the bow shaped embodiment of FIG. 1 showing its recessed edges.

Referring first to FIGS. 1,2 an alternate embodiment of the present invention is shown. The alternate embodiment consists of a bow shaped member 1. The bow shaped member 1 can be made of any type of material that provides desired training resistance such as lead, steel, and the like. In the bow shaped embodiment member 1 is constructed of polished brass that gives it an aesthetically appealing appearance. The aesthetic appeal of member 1 can also be enhanced by coating it with various colors of urethane coating. Member 1 can be coated with urethane that can render the member 1 extremely smooth or textured, as desired.

In the bow shaped embodiment, member 1 is roughly two and one half inches long $d_1$, one quarter inch thick $d_3$, and five eighths inch wide $d_2$. The weight of member 1 can be varied by changing its size, shape or the substance from which it is manufactured. A smaller member 1 will be lighter than the preferred embodiment of member 1. A hollow member 1 will be lighter than the preferred embodiment of member 1. A member 1 constructed of lead will be heavier than the preferred embodiment of member 1 that is constructed of polished brass. By varying the weight of the member 1, the user can also vary the intensity of his or her workout.

Figure 9:
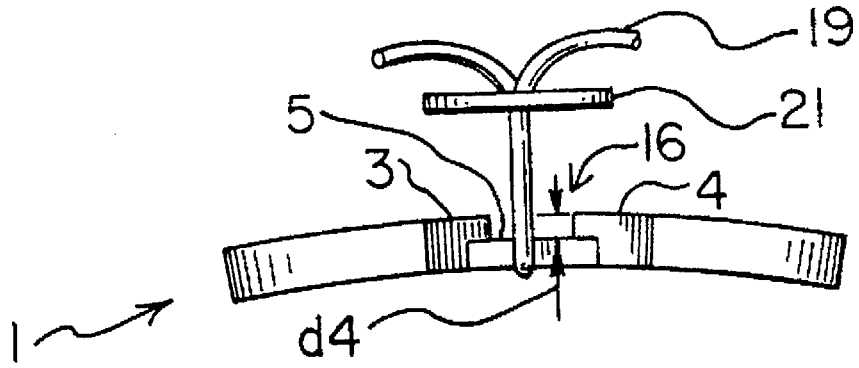
FIG. 9 is a side plan view of the alternate embodiment shown in FIG. 2.

Referring to FIG. 9 and FIG. 2, member 1 has two angled recessed edges 3, 4 thereby forming a narrower bar 5 that connects the end masses 6, 7. The edges 3 and 4 are both angled to create a triangle that widens away from the bar 5 and creates a "X" shaped channel 16 for receiving the cross 10 of shoelace 11. Edges 3 and 4 are also recessed such that they both have a height $d_4$ that extends above bar 5. Member 1 can be curved to correspond and fit to the slightly convex top 9 of a wearer shoe 8.

Referring again to FIG. 1, the user slides the member 1 under the cross 10 of the shoelace 11. A longitudinal axis 70 runs from the toe 71 to heel (not shown) of the shoe 8. The position of member 1 is aligned perpendicular to longitudinal axis 70. The tension of the tied shoelaces 11 will snugly clamp member 1 between mass ends 6,7, on bar 5. Member 1 is, thus, held in position on top of the shoe 8 below the cross 10 of the laces 11. The member 1 can be secured under any cross formed by the laces 11, thereby allowing weight to be concentrated at different positions on a user's foot. Positioning weight at predetermined strategic locations allows the user to stimulate different muscles or muscle groups. The user can also use several members 1 on each shoe, thus increasing the weight and, thereby the intensity of the workout.

Figure 3:
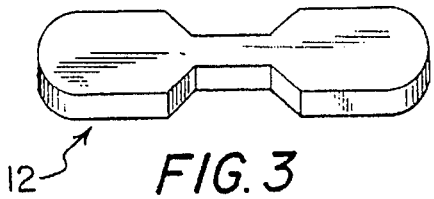
FIG. 3 is a top perspective view of another alternate embodiment of the present invention that is not curved and does not have recessed edges.

Referring next to FIG. 3 an alternate embodiment 12 of the removable shoe weight is shown. The alternate embodiment is not curved and is not recessed. The member 12 can be constructed, modified and used as described for the preferred embodiment 1.

Figure 4:
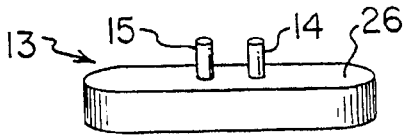
FIG. 4 is a side plan view of another alternative "post" embodiment of the present invention.

Referring next to FIG. 4 another alternate embodiment of the shoe weight 13 is shown. Member 13 can be constructed and modified in the same manner as described for the preferred embodiment 1. Member 13 is oval shaped with two prongs fixed to its upper surface 26. Member 13 is slipped between a shoe's upper surface and underneath its laces (not shown). The prongs 14, 15 protrude around any cross formed by the laces, thereby utilizing the lace tension to secure the member 13 in place. The prongs 14, 15 prevent the member 13 from slipping out of position.

Figure 5:
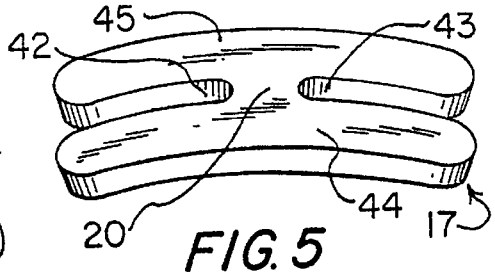
FIG. 5 is a top perspective view of the "H" shaped embodiment of the present invention.

Referring next to FIG. 5 an alternate "H" shaped embodiment 17 of the shoe weight is shown. The "H" shaped embodiment consists of two mass ends 44, 45 connected by a bar 20. Two shoelace receiving channels 42, 43 run parallel to the length of the mass member. The "H" shaped embodiment is constructed and modified in the same manner as described for the preferred embodiment 1.

Figure 6:
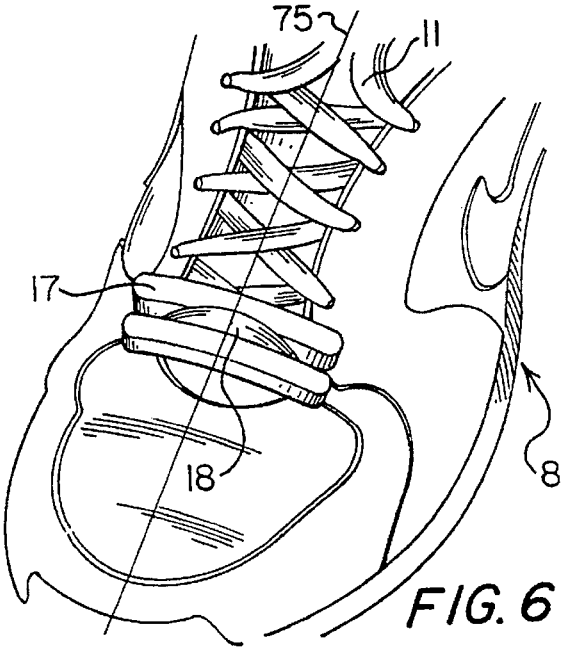
FIG. 6 is a top perspective view of the "H" shaped embodiment of FIG. 5 mounted on a prior art shoe.

Referring next to FIG. 6 the "H" shaped embodiment 17 of the shoe weight is shown mounted on a conventional running shoe 8. The "H" shaped embodiment 17 slides under the first loop 18 of shoelace 11. The "H" shaped member is aligned perpendicular to the longitudinal axis 75. The shoelace 11 is then tightened, with the resulting tension holding the "H" shaped member 17 firmly in place with the shoelace 11 snugly engaging the shoelace receiving channels 42, 43.

Figure 7:
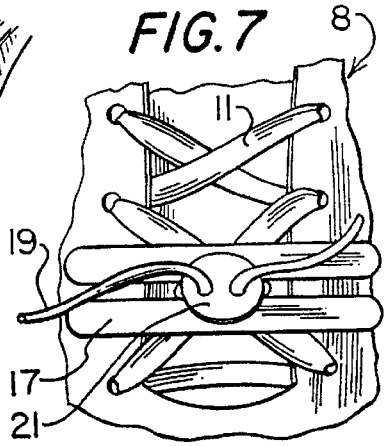
FIG. 7 is a top perspective view of the "H" shaped embodiment of FIGS. 5, 6 mounted on a prior art shoe with a secondary safety securing device.

Referring next to FIG. 7, the "H" shaped embodiment 17 is shown mounted on a conventional running shoe 8. The member 17 is placed on top of a cross formed by the shoelaces 11. A cord 19 is threaded under the cross of the laces 11, up around the narrow bar 20 of the member 17 and through the eyelets of the securing member 21. The securing member 21 slides next to the member 17 and grips the cord 19 securely in its cord receiving channels 42, 43, thereby holding the member 17 securely in place. The cord 19 is constructed of elastic, string, or the like.

The securing member 21 and cord 19 can be used in a like fashion with any of the embodiments described in FIGS. 1–4, and 8 to act as a secondary safety device. Thus, if any of the embodiments were jarred from position they would remain secured in place by securing member 21 and cord 19.

Figure 8:
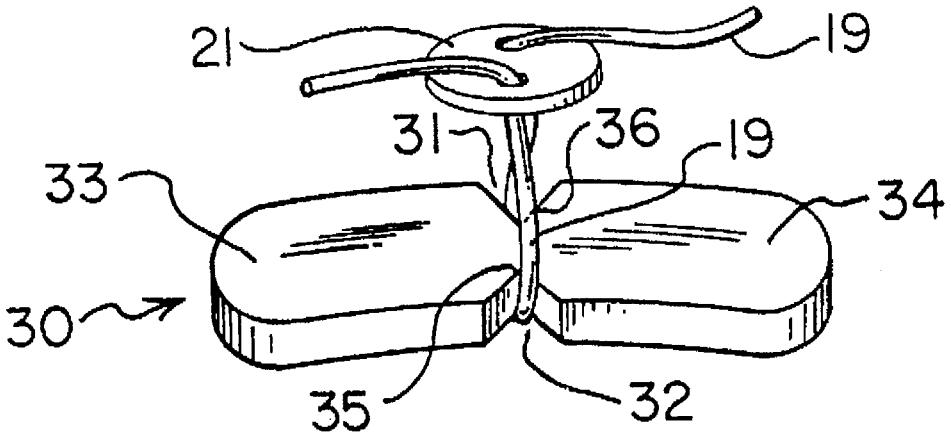
FIG. 8 is a top perspective view of the preferred "figure 8" shaped embodiment of the present invention.

Referring next to FIG. 8 the preferred "figure 8" embodiment the present invention is shown. The "figure 8" embodiment consists of an elongated member 30 with two triangular notches 31, 32 cut in its center to create two mass ends 33, 34. The triangular notches 31, 32 are cut opposing each other with the narrowest points 35, 36 closest to each other. The triangular notches 31, 32 allow the member 30 to be used with any size shoelace or with any shoelace eyelet spacing.

Member 30 is secured under a cross formed by the laces 11. The laces 11 fit into the triangular notches 31, 32 until the laces 11 reach a width of the notches 31, 32 that secures them in place. The tension of the shoelaces 11 further holds the member 30 in place. The securing member 21 shown in FIG. 7 can also be positioned above the notches 31, 32 to act as a secondary safety device.

Member 30 can be constructed and modified in the same manner as described for member 1 of the preferred embodiment shown in FIG. 2.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A removable shoe weight for working predetermined muscle groups, comprising:

a first and a second mass end;

a reduced central width forming a connecting bar between said first and second mass end functioning to fit securely between a top of a shoe and a cross of a shoelace, thereby working predetermined muscle groups by positioning said shoe weight on a predetermined position on the shoe; and wherein each mass end has an inner edge that faces the connecting bar and each inner edge is recessed thereby forming an "X" shaped channel for receiving the shoelace.

2. The removable shoe weight of claim 1, wherein said removable shoe weight is curved to correspondingly fit the curved top of the shoe.

3. The removable shoe weight of claim 2, further comprising a securing member wherein said securing member further comprises a cord and a securing means, said securing means having a pair of cord receiving channels, wherein said cord may be threaded beneath the shoelace, around said bar and through said cord receiving channels of said securing means, said securing means functioning to hold said cord into said cord receiving channels, thereby preventing said shoe weight from moving out of position.

4. The removable shoe weight of claim 3, further comprising a coating functioning to protect, color and texturize said removable shoe weight.

5. A removable shoe weight for working a predetermined muscle group in combination with a shoe and a shoelace having a lace tension, comprising:

a mass member having a predetermined shape;

said mass member removably disposed between the top of the shoe and the shoelace, whereby the mass member is secured in place by a combination of the lace tension and the mass member's predetermined shape;

the predetermined muscle group may be worked by positioning said mass member at a predetermined position on the shoelace;

wherein said mass member further comprises a center, a length and a width, said width being substantially smaller in the center of said mass member than said length;

wherein said length further comprises an alignment perpendicular to a longitudinal axis of the shoe and comprises notches functioning to receive and engage the shoelace;

wherein said mass member is curved to correspondingly fit a curved top of the shoe; and further comprising a securing member functioning to act as a secondary safety device to further hold said mass member in a predetermined position on the shoe.

6. The removable shoe weight of claim 1, wherein said securing member further comprises a cord and a securing means, said securing means having a pair of cord receiving channels, wherein said cord may be threaded beneath the shoelace, around said mass member and through said cord receiving channels of said securing means, said securing means functioning to hold said cord into said cord receiving channels, thereby preventing said mass member from moving out of position.

7. The removable shoe weight of claim 6, wherein said mass member further comprises a coating functioning to protect, color and texturize said mass member.

8. The removable shoe weight of claim 1, further comprising:

an upper surface; and said upper surface further comprises a first and second prong functioning to engage the shoelace and in combination with the lace tension, hold said mass member securely in a predetermined position.

9. The removable shoe weight of claim 8, further comprising a securing member wherein said securing member further comprises a cord and a securing means, said securing means having a pair of cord receiving channels, wherein said cord may be threaded beneath the shoelace, around said mass member and through said cord receiving channels of said securing means, said securing means functioning to hold said cord into said cord receiving channels, thereby preventing said mass member for moving out of position.

10. The removable shoe weight of claim 1, wherein said mass member is constructed in a predetermined series of weight magnitudes, whereby a workout intensity is varied by using different mass members from said predetermined series of weight magnitudes.

11. A removable shoe weight for working a predetermined muscle group, comprising an "H" shaped mass member having a bar connecting a first and a second mass end forming a pair of shoelace receiving channels, said mass member removably affixing to a shoelace, thereby enhancing a workout of a predetermined muscle group by positioning said mass member at a predetermined position on said shoe; and wherein said mass member is secured above a shoelace by placing said mass member on a top side of the shoelace and fixing said mass member using a securing member.

12. The removable shoe weight of claim 11, wherein said securing member further comprises a cord and a securing means, said securing means having a pair of cord receiving channels, wherein said cord may be threaded beneath the shoelace, around said mass member and through said cord receiving channels of said securing means, said securing means functioning to hold said cord receiving channels, thereby preventing said mass member from moving out of position.

* * * * *